US009428962B2

(12) United States Patent
Mahajan et al.

(10) Patent No.: US 9,428,962 B2
(45) Date of Patent: Aug. 30, 2016

(54) SELECTIVE DEPLOYMENT OF UNDERREAMERS AND STABILIZERS

(71) Applicant: Smith International, Inc., Houston, TX (US)

(72) Inventors: Manoj D. Mahajan, Houston, TX (US); Charles H. Dewey, Houston, TX (US); Sameer P. Bhoite, Conroe, TX (US); Daniel W. Brietzke, Spring, TX (US)

(73) Assignee: Smith International, Inc., Houston, TX (US)

( * ) Notice: Subject to any disclaimer, the term of this patent is extended or adjusted under 35 U.S.C. 154(b) by 246 days.

(21) Appl. No.: 14/052,107

(22) Filed: Oct. 11, 2013

(65) Prior Publication Data

US 2014/0102797 A1 Apr. 17, 2014

Related U.S. Application Data

(60) Provisional application No. 61/713,317, filed on Oct. 12, 2012.

(51) Int. Cl.
*E21B 7/28* (2006.01)
*E21B 10/32* (2006.01)

(52) U.S. Cl.
CPC ..... *E21B 7/28* (2013.01); *E21B 10/325* (2013.01)

(58) Field of Classification Search
CPC .... E21B 10/32; E21B 10/322; E21B 10/325; E21B 7/28
See application file for complete search history.

(56) References Cited

U.S. PATENT DOCUMENTS

| | | | | |
|---|---|---|---|---|
| 295,507 | A | 3/1884 | Runyan | |
| 6,289,999 | B1 | 9/2001 | Dewey et al. | |
| 6,732,817 | B2 | 5/2004 | Dewey et al. | |
| 7,416,029 | B2 | 8/2008 | Telfer et al. | |
| 7,530,400 | B2 | 5/2009 | Telfer | |
| 7,628,213 | B2 | 12/2009 | Telfer | |
| 7,673,708 | B2 | 3/2010 | Lee | |
| 8,540,035 | B2 | 9/2013 | Xu et al. | |
| 8,657,039 | B2 | 2/2014 | Radford et al. | |
| 2009/0308588 | A1* | 12/2009 | Howell | E21B 21/103 166/66.4 |
| 2010/0212886 | A1 | 8/2010 | Hall et al. | |

OTHER PUBLICATIONS

International Search Report and Written Opinion of PCT Application Serial No. PCT/US2013/064733 dated Jan. 20, 2014 (16 pages).

* cited by examiner

*Primary Examiner* — David Andrews

(57) ABSTRACT

A downhole tool for increasing a cross-sectional area of a wellbore is provided. The downhole tool may include a first drilling assembly including a first reaming tool for selectively increasing the cross-sectional area of the wellbore. A first ball seat may receive a first ball. At least one of the first ball seat and the first ball may deform to allow the first ball to pass through the first ball seat when a predetermined pressure is applied thereto. A first piston may be coupled to the first ball seat. The first ball seat and the first piston may stroke when the first ball is received within the first ball seat, thereby actuating the first reaming tool between an active state and an inactive state.

20 Claims, 9 Drawing Sheets

0°, 45°, 180°, 225° OFF
90°, 135°, 270°, 315° ON

0°, 90°, 180°, 270° OFF
45°, 135°, 225°, 315° ON

SELECTIVE DEPLOYMENT OF UNDERREAMERS AND STABILIZERS

CROSS-REFERENCE TO RELATED APPLICATIONS

This application claims the benefit of a related U.S. Provisional Patent Application having Ser. No. 61/713,317 filed Oct. 12, 2012, titled "Selective Deployment of Underreamers and Stabilizers," to Mahajan et al., the disclosure of which is incorporated by reference herein in its entirety.

BACKGROUND

Embodiments described herein generally relate to downhole tools. More particularly, such embodiments relate to underreamers and stabilizers for enlarging the diameter of a wellbore.

In the drilling of oil and gas wells, concentric casing strings are installed and cemented in the wellbore as drilling progresses to increasing depths. Each new casing string is supported within the previously installed casing string, thereby limiting the annular area available outside the uppermost casing strings for the cementing operation. Further, as successively smaller diameter casing strings are suspended, the flow area for the production of oil and gas inside the casing strings decreases as the distance from the surface increases. Therefore, to increase the annular space for the cementing operation, and to increase the production flow area, it is often desirable to enlarge the diameter of the wellbore below the lower end portion of the previous casing string.

Underreamers are used for enlarging the diameter of the wellbore below the lower end portion of the previous casing string and stabilizers are used for controlling the trajectory of the underreamer during the drilling process. An underreamer generally has two states—an inactive or collapsed state where the cutters of the underreamer are stationary and the underreamer maintains a diameter small enough to pass through the existing casing strings, and an active or expanded state where one or more arms having the cutters on the end portions thereof extend radially outward from the underreamer. In the active state, the cutters are adapted to enlarge the diameter of the wellbore. As the underreamer is lowered into deeper and harder formations, however, additional underreamers may need to be deployed.

What is needed, therefore, are improved systems and methods for running multiple underreamers and/or stabilizers downhole.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A downhole tool for increasing a cross-sectional area of a wellbore is disclosed. The downhole tool may include a first drilling assembly which includes a first reaming tool, a first ball seat, and a first piston. The first reaming tool selectively increases the cross-sectional area of the wellbore. The first ball seat may receive a first ball. At least one of the first ball seat and the first ball may deform to allow the first ball to pass through the first ball seat when a predetermined pressure is applied thereto. The first piston may be coupled to the first ball seat. The first ball seat and the first piston may stroke when the first ball is received within the first ball seat, thereby actuating the first reaming tool between an active state and an inactive state. A second drilling assembly may be axially offset from the first drilling assembly along the downhole tool. The second drilling assembly includes a second reaming tool, a second ball seat, and a second piston. The second reaming tool selectively increases the cross-sectional area of the wellbore. The second ball seat may receive a second ball. At least one of the second ball seat and the second ball may deform to allow the second ball to pass through the second ball seat when a predetermined pressure is applied thereto. The second piston may be coupled to the second ball seat. The second ball seat and the second piston may stroke when the second ball is received within the second ball seat, thereby actuating the second reaming tool between an active state and an inactive state.

In another embodiment, the downhole tool may include a first drilling assembly which includes a first reaming tool, a first ball seat, and a first piston. The first reaming tool selectively increases the cross-sectional area of the wellbore. The first ball seat may receive a ball. At least one of the first ball seat and the ball may deform to allow the ball to pass through the first ball seat when a predetermined pressure is applied thereto. The first piston may be coupled to the first ball seat. The first ball seat and the first piston may stroke when the ball is received within the first ball seat. A first indexing mechanism may be coupled to the first piston. The first indexing mechanism may actuate the first reaming tool between an active state and an inactive state after each stroke of the first piston. A second drilling assembly may be axially offset from the first drilling assembly along the downhole tool. The second drilling assembly includes a second reaming tool, a second ball seat, and a second piston. The second reaming tool selectively increases the cross-sectional area of the wellbore. The second ball seat may receive the ball. At least one of the second ball seat and the ball may deform to allow the ball to pass through the second ball seat when a predetermined pressure is applied thereto. The second piston may be coupled to the second ball seat. The second ball seat and the second piston may stroke when the ball is received within the second ball seat. A second indexing mechanism may be coupled to the second piston. The second indexing mechanism may actuate the second reaming tool between an active state and an inactive state after two strokes of the second piston.

A method for increasing a cross-sectional area of a wellbore is also disclosed. The method includes running a downhole tool into the wellbore. The downhole tool includes first and second drilling assemblies coupled thereto and axially offset from one another. A first ball may be received within a first ball seat of the first drilling assembly. At least one of the first ball seat and the first ball may deform when a predetermined pressure is reached to allow the first ball to pass through the first ball seat. The first ball seat and a first piston coupled thereto move in response to the first ball being received in the first ball seat, thereby actuating a first reaming tool of the first drilling assembly between an active state and an inactive state. The first reaming tool may increase a cross-sectional area of the wellbore in the active state. A second ball may be received within a second ball seat of the second drilling assembly. At least one of the second ball seat and the second ball may deform when the predetermined pressure is reached to allow the second ball to pass through the second ball seat. The second ball seat and a second piston coupled thereto move in response to the second ball being received in the second ball seat, thereby actuating a second reaming tool of the second drilling assembly between the active state and the inactive state. The second reaming tool may increase the cross-sectional area of the wellbore in the active state.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings illustrate only exemplary embodiments and are therefore not to be considered limiting of scope, for the invention may admit to other equally effective embodiments.

FIG. 2-1 depicts a cross-sectional view of a portion of a drilling assembly depicted in FIG. 1, according to one or more embodiments disclosed.

FIG. 2-2 depicts a cross-sectional view of an illustrative piston assembly in the drilling assembly depicted in FIG. 2-1, according to one or more embodiments disclosed.

DETAILED DESCRIPTION

Figure 1:
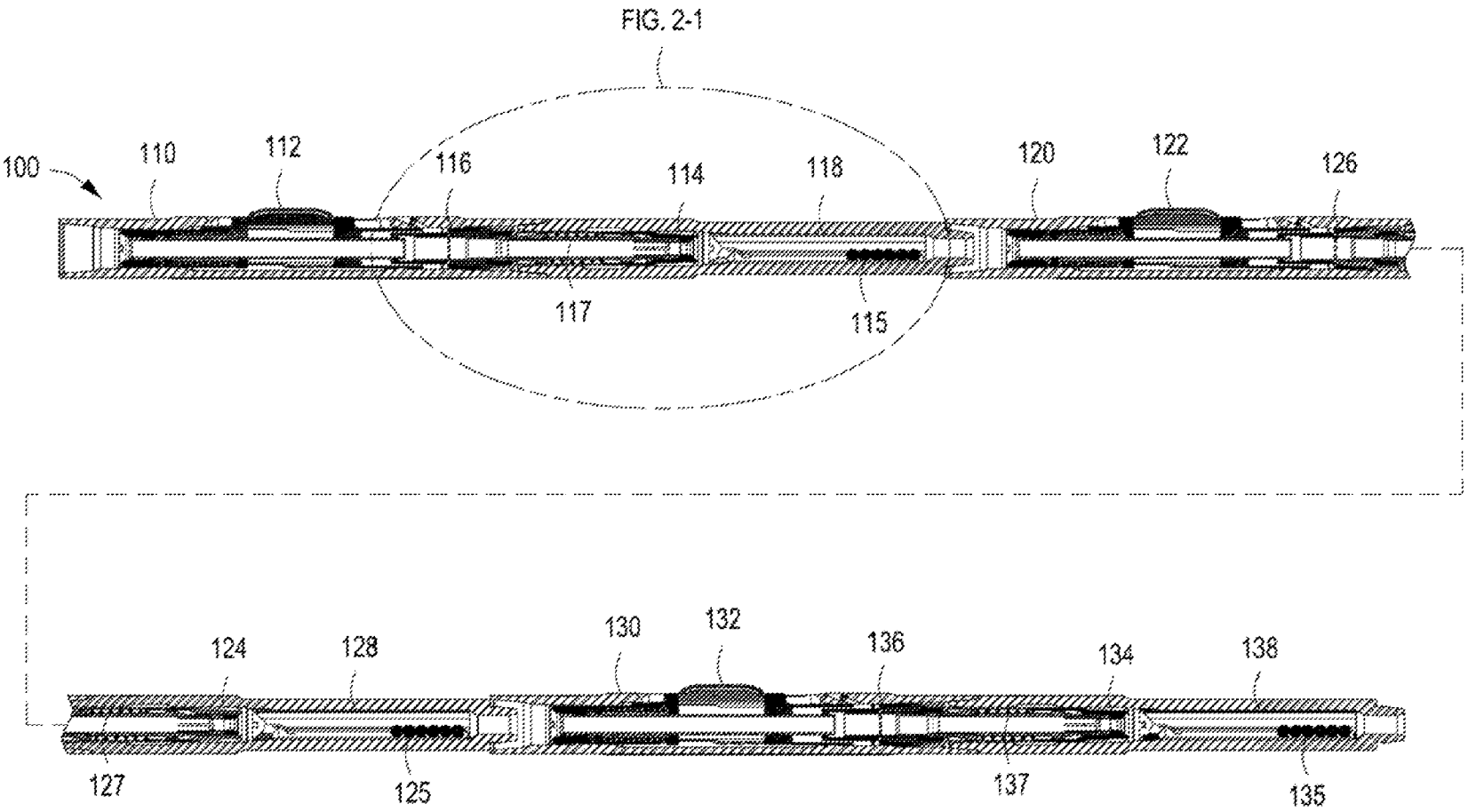
FIG. 1 depicts a cross-sectional view of an illustrative downhole tool including a plurality of drilling assemblies coupled thereto in tandem, according to one or more embodiments disclosed.
Figures 1, 2:
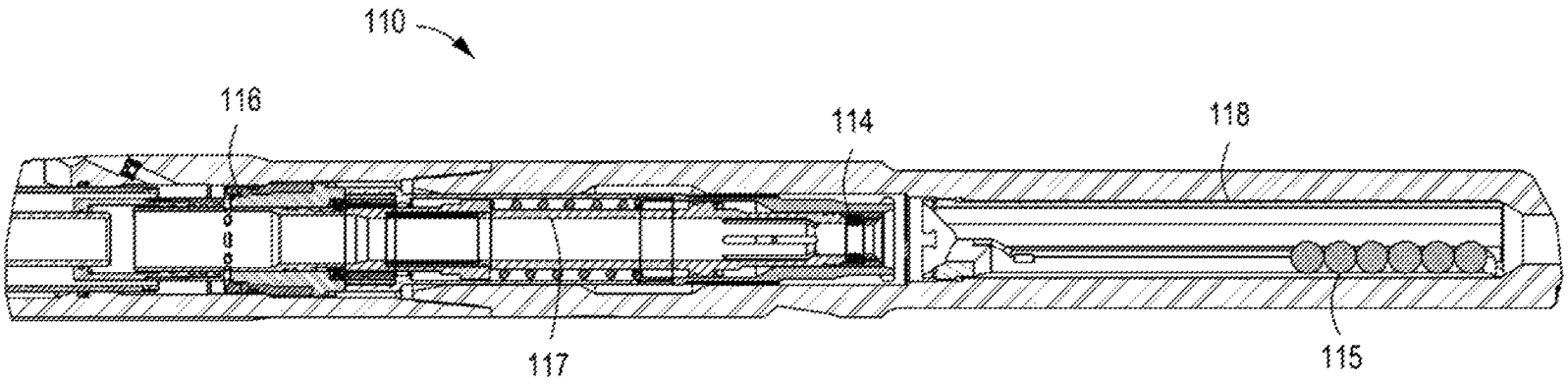
Figure 2:
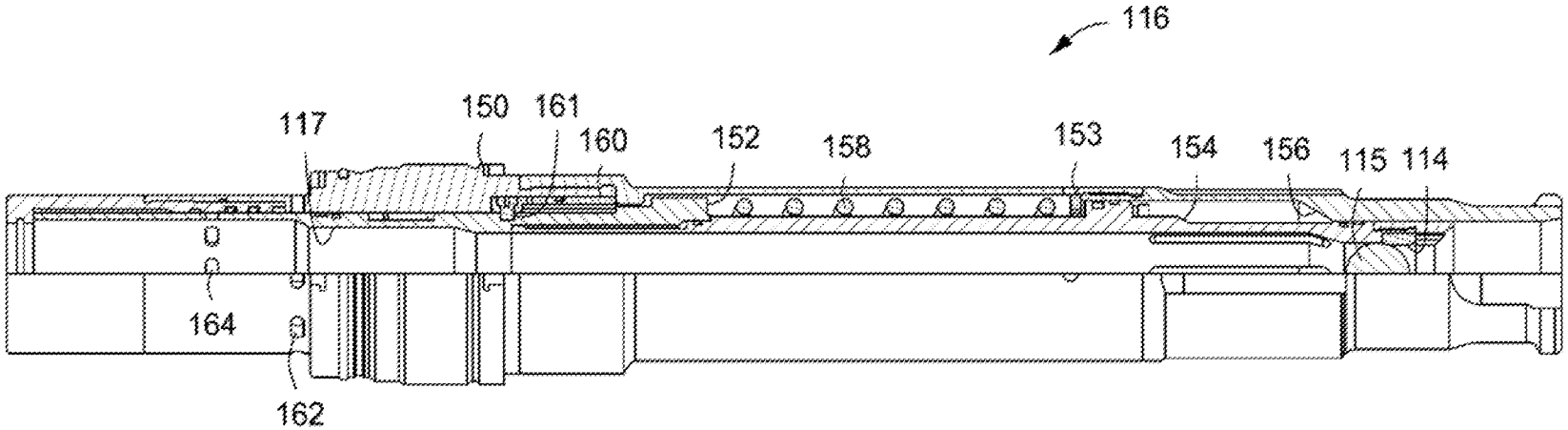

FIG. 1 depicts a cross-sectional view of an illustrative downhole tool 100 including a plurality of drilling assemblies 110, 120, 130 coupled thereto in tandem, and FIG. 2-1 depicts a cross-sectional view of a portion of the drilling assembly 110, according to one or more embodiments. While drilling assemblies 120 and 130 are not shown in greater detail, those skilled in the art will readily understand that such drilling assemblies and their operation are similar to drilling assembly 110. The drilling assemblies 110, 120, 130 are positioned in series along the tool 100. More particularly, the drilling assemblies 110, 120, 130 are positioned axially-offset from one another along the length of the tool 100. Although three drilling assemblies 110, 120, 130 are shown, it may be appreciated that the number of drilling assemblies 110, 120, 130 on the tool 100 may range from a low of 1, 2, 3 or 4 to a high of 6, 8, 10 or more. Illustrative drilling assemblies 110, 120, 130 are shown and described in U.S. Pat. No. 6,732,817.

The drilling assemblies 110, 120, 130 each include one or more reaming tools 112, 122, 132, one or more stabilizers (not shown), or a combination thereof. For purposes of simplicity, the foregoing description will refer to reaming tools 112, 122, 132; however, it may be appreciated that any of 112, 122, 132 may also refer to a stabilizer or a reaming tool/stabilizer combination. It may also be appreciated to those skilled in the art that the drilling assemblies of the various embodiments of FIGS. 3-4 and 8-9 may also include one or more reaming tools, one or more stabilizers (not shown), or a combination thereof.

Each drilling assembly 110, 120, 130 includes a piston assembly 116, 126, 136 adapted to actuate the corresponding reaming tool 112, 122, 132. FIG. 2-2 depicts a cross-sectional view of an illustrative piston assembly 116 in the drilling assembly 110, according to one or more embodiments. The piston assembly 116 includes a mandrel 150 having a cam-piston 117 disposed therein. The cam-piston 117 is adapted to move or slide axially within the mandrel 150. A ball seat 114 may be coupled to or integral with a distal end portion of the cam-piston 117. The ball seat 114 is adapted to receive a ball 115 dropped into the wellbore from the surface. The ball 115 forms a fluid tight seat against the ball seat 114 allowing pressure to build up within the bore of the piston assembly 116. As the pressure builds, the cam-piston 117 moves in a first axial direction within the mandrel 150 until a shoulder 154 extending radially outward from the cam-piston 117 contacts a shoulder 156 extending radially inward from the mandrel 150 preventing further movement. As the cam-piston 117 moves in the first axial direction, another shoulder 152 extending radially outward therefrom may compress or collapse a spring 158 against a stationary (relative to the cam-piston 117) spacer 153.

The ball seat 114 and/or the ball 115 may be deformable. For example, the ball seat 114 may be deformable and the ball 115 may be non-deformable. As used herein, the term "deformable" refers to the ability of an element to change shape temporarily and then return to its original shape. When the pressure within the bore reaches a predetermined level, the ball seat 114 and/or the ball 115 may deform to allow the ball 115 to pass through the ball seat 114. Once the ball 115 passes through the ball seat 114, the ball 115 may become retained within a ball catcher 118 disposed downstream from the ball seat 114 (see FIGS. 1 and 2-1). Illustrative ball catchers 118 are shown and described in U.S. Patent Publication No. 2007/027412. Further, once the ball 115 passes through the ball seat 114, the spring 158 may stretch or expand, thereby pushing the shoulder 152 and the cam-piston 117 in the second axial direction.

Each time the cam-piston 117 moves axially within the mandrel 150, a cartridge 160 disposed between the cam-piston 117 and the mandrel 150 may pivot or rotate at least partially around the circumference of the cam-piston 117. The cartridge 160 may have a pin or protrusion 161 extending radially-inward therefrom that is arranged and designed to move through a slot or groove (not shown but see, e.g., 502 of FIG. 5) in an indexing mechanism (not shown but see, e.g., 500 of FIG. 5) disposed on the cam-piston 117 (see generally FIGS. 5-7, which illustrate the similar arrangement of cam-piston 427, slot or groove 602 and indexing mechanism 600). As the cam-piston 117 moves axially, the protrusion 161 slides through the groove 502 in the indexing mechanism 500 and causes the cartridge 160 to rotate between the cam-piston 117 and the mandrel 150, as similarly described in more detail below with respect to FIGS. 5-7. The interaction of the protrusion 161 of the cartridge 160 and the indexing mechanism 500 of the cam-piston 117 determines the axial resting position of the cam-piston 117 after each stroke.

The axial resting position of the cam-piston 117 relative to the mandrel 150 determines whether one or more ports 162 formed radially through the mandrel 150 are aligned with one or more ports 164 formed radially through the cam-piston 117. When the ports 162, 164 are aligned, pressurized fluid may flow therethrough actuating the reaming tool 112 into an "active" position, and when the ports 162, 164 are axially offset (as shown), the reaming tool 112 is actuated into an "inactive" position. In at least one embodiment, after a single stroke of the cam-piston 117, the ports 162, 164 may be aligned and the reaming tool 112 may actuate into the active state. However, in another embodiment, it may take two (or more) strokes of the cam-piston 117 for the ports 162, 164 to align such that the reaming tool 112 actuates into the active state.

In the inactive state, one or more cutters on the reaming tool 112 may be stationary and folded into the body of the reaming tool 112 allowing the reaming tool 112 to maintain a diameter small enough to pass through the existing casing strings. In the active state, the reaming tool 112 may be in an expanded state where one or more arms with the cutters on the end portions thereof extend radially outward. Further, in the active state, the cutters of the reaming tool 112 may be adapted to cut into the formation and enlarge the diameter of the wellbore.

Referring now to FIGS. 1, 2-1, and 2-2, the ball seats 114, 124, 134 in the drilling assemblies 110, 120, 130 have an aperture defined or formed axially therethrough. At least a portion of an inner surface of the ball seat, i.e., the surface defining the aperture, may be frustoconical. Balls 115, 125, 135 having different diameters are dropped into the wellbore from the surface and travel into the tool 100. In at least one embodiment, the aperture in the ball seat 114 may have a diameter less than a diameter of the "large" ball 115 but greater than the diameter of the "medium" ball 125 and "small" ball 135. As such, the medium and small balls 125, 135 flow through the ball seat 114 while the large ball 115 becomes lodged in the ball seat 114 and obstructs flow therethrough until a predetermined pressure forces the ball seat 114 (or ball 115) to deform to allow the ball 115 to pass therethrough. Similarly, the aperture in the ball seat 124 may have a diameter less than a diameter of the medium ball 125 but greater than the diameter of the small ball 135. As such, the small ball 135 flows through the ball seat 124 while the medium ball 125 becomes lodged in the ball seat 124 and obstructs flow therethrough until a predetermined pressure forces the ball seat 124 (or ball 125) to deform to allow the ball 125 to pass therethrough. Illustrative ball seats 114, 124, 134 and balls 115, 125, 135 are shown and described in U.S. Pat. No. 7,416,029.

In operation, the first drilling assembly 110 is actuated by dropping a large ball 115 down the drill string from the surface, and the large ball 115 becomes lodged in the ball seat 114. Pressure is then applied to the drill string from the surface via pump drilling fluid. As the pressure builds, the cam-piston 117 in the piston assembly 116 moves in the first axial direction until the pressure reaches a predetermined amount where the ball seat 114 (or the large ball 115) deforms and allows the large ball 115 to pass therethrough and become retained within the ball catcher 118. Once the large ball 115 passes through the ball seat 114, the cam-piston 117 moves in the second axial direction due to the expansion of the spring 158, thereby actuating the reaming tool 112 between the inactive state and the active state or vice versa. The first drilling assembly 110 may be actuated between the active and inactive states by dropping subsequent large balls 115 into the tool 100.

The second drilling assembly 120 is actuated by dropping a medium ball 125 down the drill string from the surface, and the medium ball 125 becomes lodged in the ball seat 124. As the medium ball 125 is smaller than the large ball 115, it may pass through the ball seat 114 and the ball catcher 118 without being retained therein. Pressure is then applied to the drill string from the surface via pump drilling fluid. As the pressure builds, the cam-piston 127 of the piston assembly 126 moves in the first axial direction until the pressure reaches a predetermined amount where the ball seat 124 (or the medium ball 125) deforms and allows the medium ball 125 to pass therethrough and become retained within the ball catcher 128. Once the medium ball passes through the ball seat 124, cam-piston 127 moves in the second axial direction due to the expansion of the spring, thereby actuating the reaming tool 122 between the inactive state and the active state or vice versa. The second drilling assembly 120 may be actuated between the active and inactive states by dropping subsequent medium balls 125 into the tool 100.

The third drilling assembly 130 is actuated by dropping a small ball 135 down the drill string from the surface, and the small ball 135 may become lodged in the ball seat 134. As the small ball 135 is smaller than the large and medium balls 115, 125, it may pass through the ball seats 114, 124 and the ball catchers 118, 128 without becoming retained therein. Pressure is then applied to the drill string from the surface via pump drilling fluid. As the pressure builds, the cam-piston 137 of the piston assembly 136 moves in the first axial direction until the pressure reaches a predetermined amount where the ball seat 134 (or the small ball 135) deforms and allows the small ball 135 to pass therethrough and become retained within the ball catcher 138. Once the small ball 135 passes through the ball seat 134, the cam-piston 137 moves in the second axial direction due to the expansion of the spring, thereby actuating the reaming tool 132 between the inactive state and the active state or vice versa. The third drilling assembly 130 may be actuated between the active and inactive states by dropping subsequent small balls 135 into the tool 100. The varying sizes of the ball seats 114, 124, 134 and the balls 115, 125, 135 may allow the reaming tools, e.g., 112, to be selectively actuated between the inactive and active states independent of the other reaming tools, e.g., 122, 132.

The drilling assemblies 110, 120, 130 may each have the same cross-sectional length (e.g., diameter) when in the active state. As such, each of the drilling assemblies 110, 120, 130 may be arranged and designed to increase the diameter of the wellbore to a single predetermined diameter. In another embodiment, one or more of the drilling assemblies (e.g., drilling assembly 110) may have a different cross-sectional length (e.g., diameter) than one or more of the other drilling assemblies (e.g., drilling assemblies 120, 130) when in the active state. As such, the drilling assembly 110 may be arranged and designed to increase the diameter of the wellbore to a first diameter, and the drilling assemblies 120, 130 may be arranged and designed to increase the diameter of the wellbore to a second, different diameter.

Figure 3:
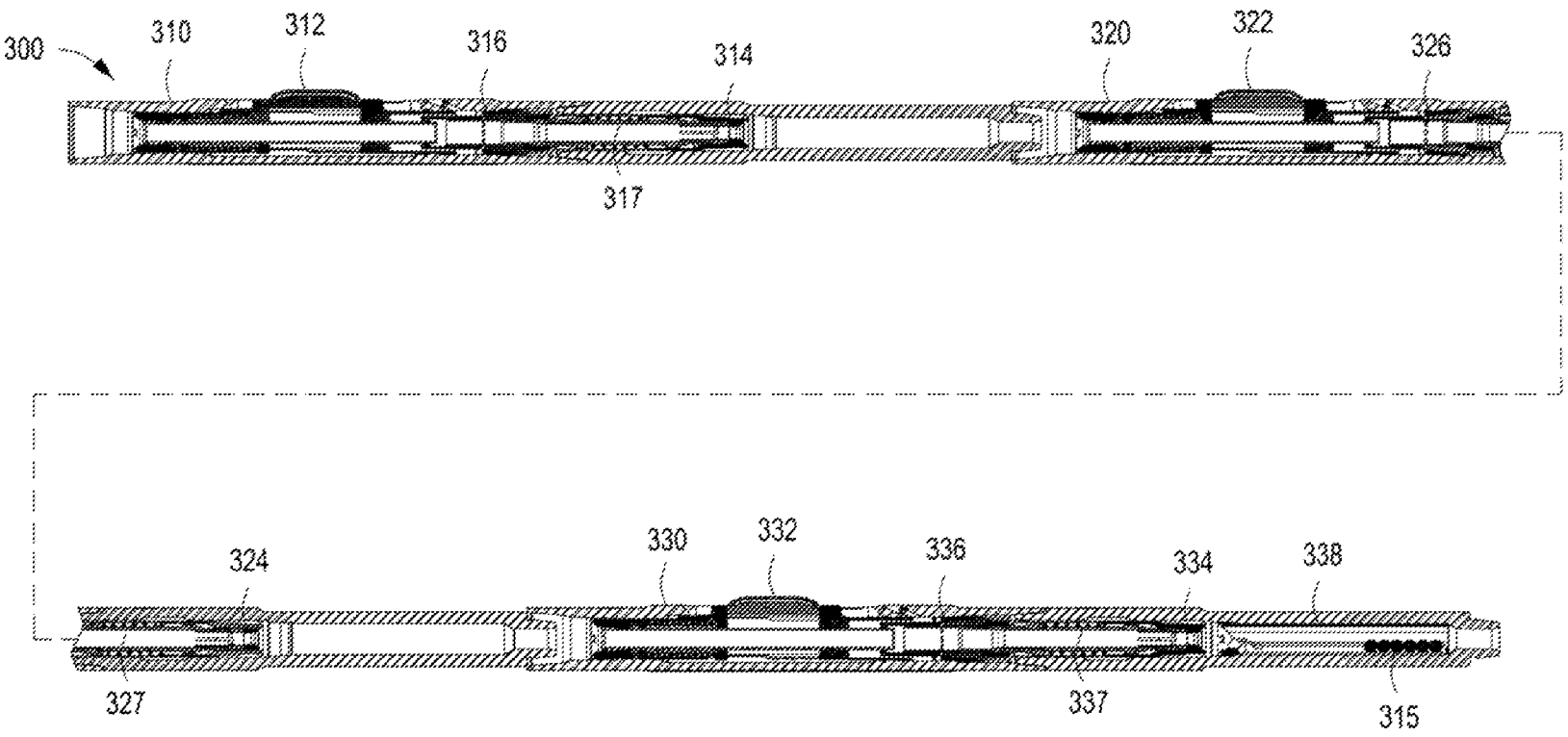
FIG. 3 depicts a cross-sectional view of another illustrative downhole tool including a plurality of drilling assemblies coupled thereto in tandem, according to one or more embodiments disclosed.

FIG. 3 depicts a cross-sectional view of another illustrative downhole tool 300 including a plurality of drilling assemblies 310, 320, 330 coupled thereto in tandem, according to one or more embodiments. Although three drilling assemblies 310, 320, 330 are shown, it may be appreciated that more or fewer may be used. The drilling assemblies 310, 320, 330 may be generally similar to the drilling assemblies 110, 120, 130 depicted in FIG. 1, and like components will not be described again in detail. The ball seats 314, 324, 334 in the drilling assemblies 310, 320, 330, however, may each define an aperture with substantially the same cross-sectional area, e.g., diameter. Accordingly, a single ball 315 may actuate multiple drilling assemblies 310, 320, 330 in sequence.

In operation, a ball 315 is dropped down the drill string from the surface, and the ball 315 becomes lodged in the ball seat 314 of the first drilling assembly 310. Pressure may then be applied to the drill string from the surface via pump drilling fluid. As the pressure builds, the cam-piston 317 moves in the first axial direction until the pressure reaches a predetermined amount where the ball seat 314 (or ball 315) deforms and allows the ball 315 to pass therethrough. The cam-piston 317 then moves via spring action in the second axial direction, thereby actuating the first reaming tool 312 between the inactive state and the active state or vice versa.

The ball 315 may then flow through the tool 300 and become lodged in the ball seat 324 of the second drilling assembly 320. Pressure may again be applied to the drill string from the surface via pump drilling fluid. As the pressure builds, the cam-piston 327 moves in the first axial direction until the pressure reaches a predetermined amount where the ball seat 324 (or ball 315) deforms and allows the ball 315 to pass therethrough. The cam-piston 327 then moves via spring action in the second axial direction, thereby actuating the second reaming tool 322 between the inactive state and the active state or vice versa.

The ball 315 may then flow through the tool 300 and become lodged in the ball seat 334 of the third drilling assembly 330. Pressure may again be applied to the drill string from the surface via pump drilling fluid. As the pressure builds, the cam-piston 337 moves in the first axial direction until the pressure reaches a predetermined amount where the ball seat 334 (or ball 315) deforms and allows the ball 315 to pass therethrough. The cam-piston 337 then moves via spring action in the second axial direction, thereby actuating the third reaming tool 332 between the inactive state and the active state or vice versa. When the ball 315 passes through the last drilling assembly, e.g., 330, the ball 315 may become retained within the ball catcher 338. Thus, each drilling assembly 310, 320, 330 may be actuated in sequence by a single ball 315.

Figure 4:
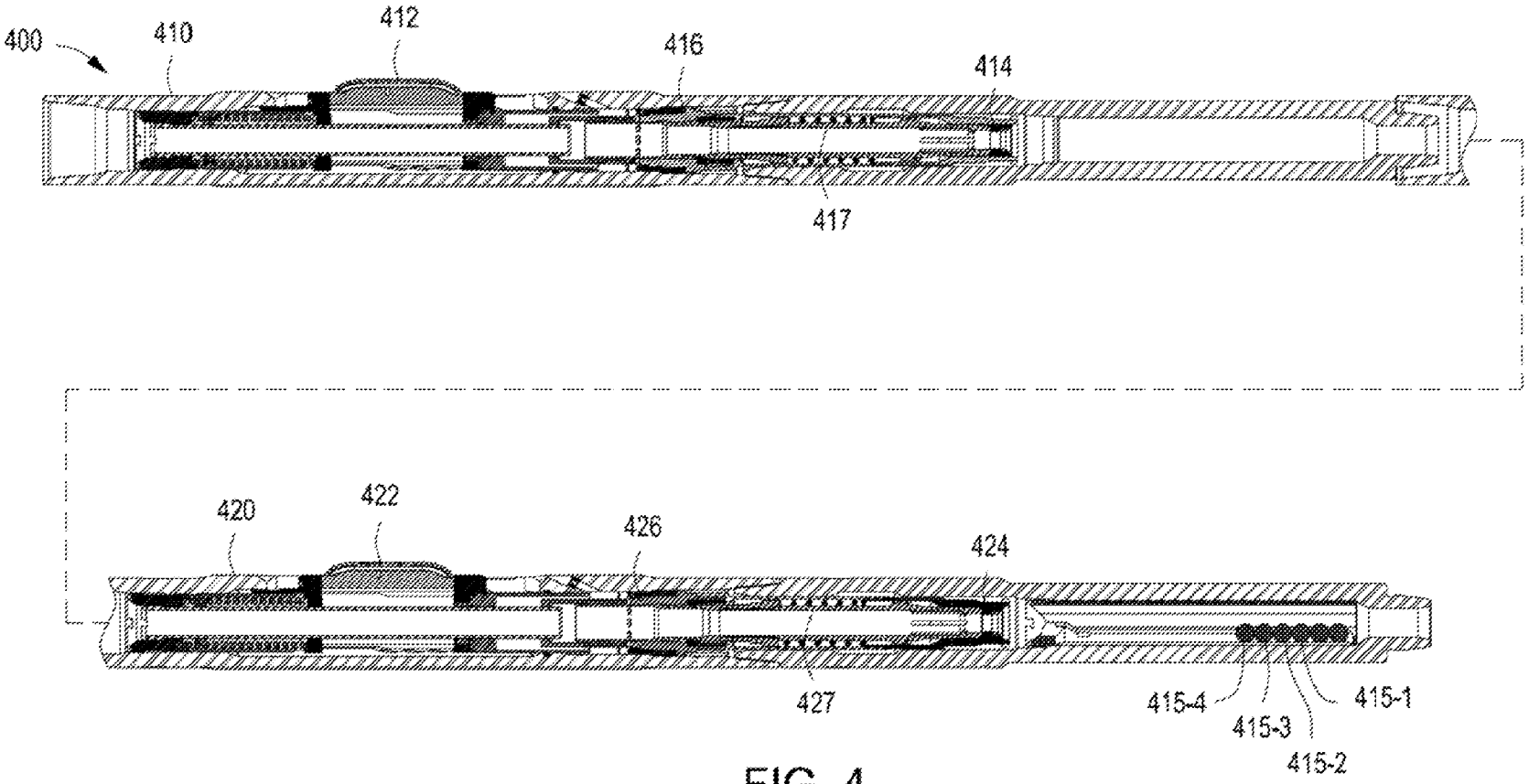
FIG. 4 depicts a cross-sectional view of yet another illustrative downhole tool including a plurality of drilling assemblies coupled thereto in tandem, according to one or more embodiments disclosed.
Figure 5:
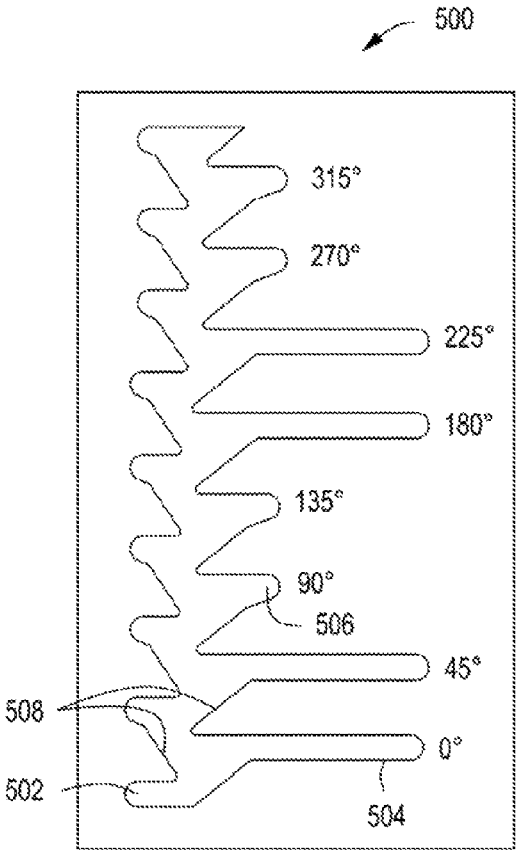
FIGS. 5 and 6 depict cross-sectional views of illustrative indexing mechanisms for the drilling assemblies depicted in FIG. 4, according to one or more embodiments disclosed.
Figure 6:
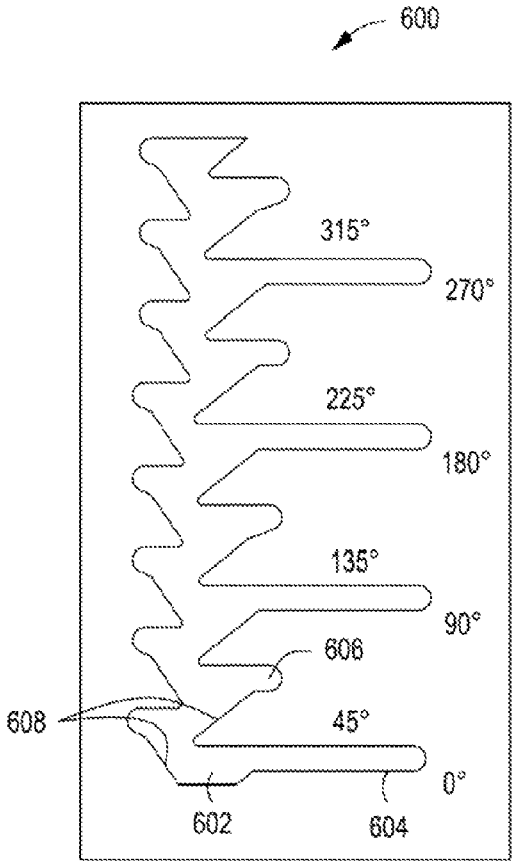
Figure 7:
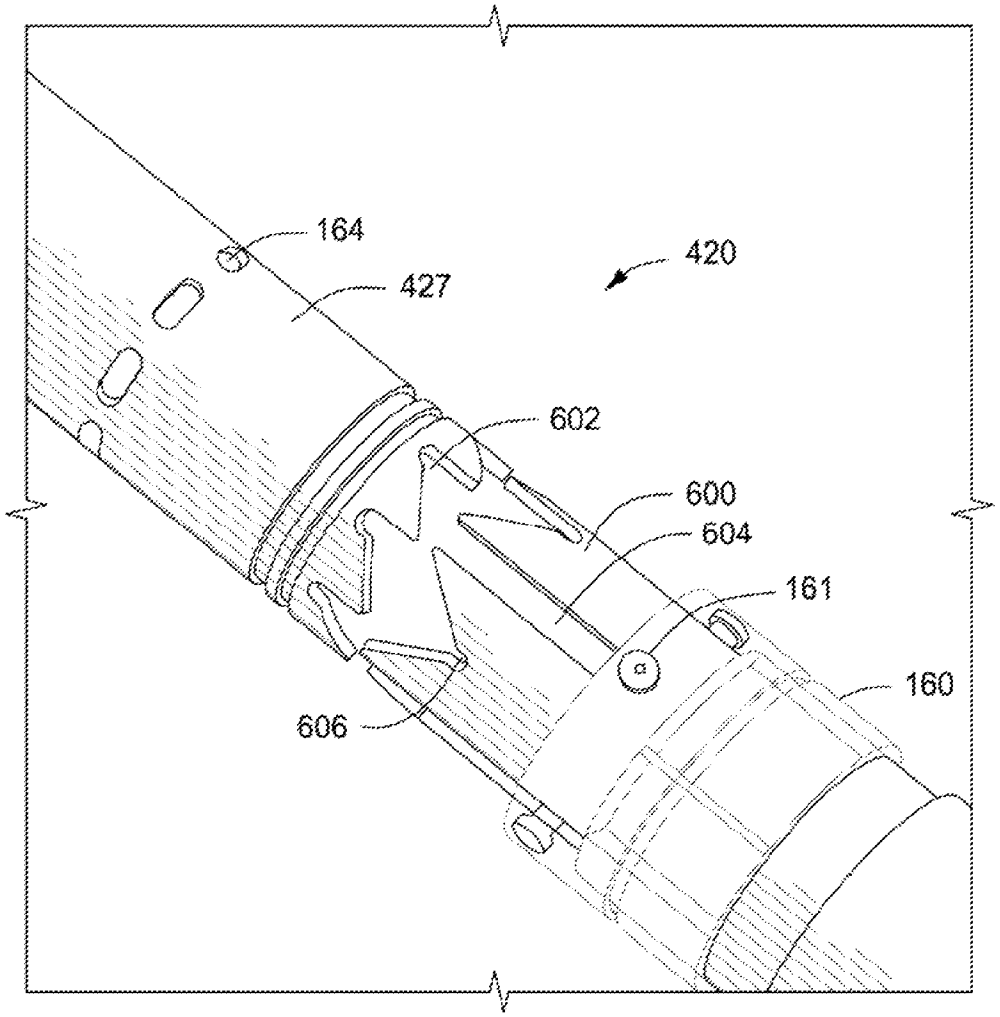
FIG. 7 depicts a perspective view of a portion of a cam-piston in FIG. 4 having the indexing mechanism of FIG. 6 coupled thereto, according to one or more embodiments disclosed.

FIG. 4 depicts a cross sectional view of yet another illustrative downhole tool 400 including a plurality of drilling assemblies 410, 420 coupled thereto in tandem, FIGS. 5 and 6 depict illustrative indexing mechanisms 500, 600 for the drilling assemblies 410, 420, and FIG. 7 depicts a perspective view of a portion of the cam-piston 427 having the indexing mechanism 600 coupled thereto, according to one or more embodiments.

The drilling assemblies 410, 420 may be generally similar to the drilling assemblies 310, 320 depicted in FIG. 3, and like components will not be described again in detail. For example, the ball seats 414, 424 in the drilling assemblies 410, 420 may each define an aperture with substantially the same cross-sectional area, e.g., diameter, such that a single ball 415 may actuate the drilling assemblies 410, 420 in sequence. The drilling assemblies 410, 420, however, may include different indexing mechanisms 500, 600 adapted to actuate the reaming tools 412, 422 between the inactive state and the active state or vice versa.

The indexing mechanisms 500, 600 are coupled to and adapted to move with the cam-pistons 417, 427. Although shown as flat in FIGS. 5 and 6, the indexing mechanisms 500, 600 may be cylindrical or annular and have a grooved path 502, 602 formed circumferentially within the inner and/or outer surface thereof (see FIG. 7). The grooved paths 502, 602 may include "long" grooves 504, 604 and "short" grooves 506, 606. The grooves 504, 506, 604, 606 may be circumferentially offset from one another. For example, the grooves 504, 506 may be circumferentially offset from one another by 90°, and the grooves 604, 606 may be circumferentially offset from one another by 45°, as shown; however, other distances are also contemplated herein.

The cartridge 160 disposed between the cam-piston 417, 427 and the mandrel 150 (see, e.g., FIG. 2-2, which illustrates a similar arrangement with cam-piston 117), may have a protrusion 161 extending radially-inward therefrom that is adapted to travel through the grooved path 502, 602 of the indexing mechanism 500, 600. For example, each time the cam-pistons 417, 427 stroke back and forth, sloped surfaces 508, 608 in the indexing mechanisms 500, 600 may cause the protrusion 161, and thus the cartridge 160, to at least partially rotate about a longitudinal axis therethrough.

In at least one embodiment, when the protrusion 161 of the cartridge 160 comes to rest in a long groove 504, 604 of the indexing mechanism 500, 600 after a stroke of the cam-piston 417, 427, the reaming tool 412, 422 is in the inactive state due to the misalignment of the ports 162, 164, and when the protrusion 161 of the cartridge 160 comes to rest in a short groove 506, 606 of the indexing mechanism 500, 600 after a stroke of the cam-piston 417, 427, the reaming tool 412, 422 is in the active state due to the alignment of the ports 162, 164 (see, e.g., FIG. 2-2, which illustrates a similar arrangement with cam-piston 117).

Accordingly, the first indexing mechanism 500 may require two strokes of the cam-piston 417 to actuate the first reaming tool 412 into the active state while the second indexing mechanism 600 may require one stroke of the cam-piston 427 to actuate the second reaming tool 422 into the active state. In the exemplary embodiment shown in FIG. 5, the first reaming tool 412 may start in the inactive state (0°) and remain in the inactive state after the first stroke (45°). The first reaming tool 412 may then actuate into the active state after the second stroke (90°) and remain in the active state after the third stroke (135°). The first reaming tool 412 may then actuate into the inactive state after the fourth stroke (180°) and remain in the inactive state after the fifth stroke (225°). The first reaming tool 412 may then actuate into the active state after the sixth stroke (270°) and remain in the active state after the seventh stroke (315°), thereby completing the cycle. In contrast, the second indexing mechanism 600 may start in the inactive state and actuate into the active state after the first stroke (45°). The second indexing mechanism 600 may then actuate between the active state and the inactive state after each subsequent stroke, as shown.

Thus, in operation, a first ball 415-1 may be dropped down the drill string from the surface. The first ball 415-1 may cause the first and second cam-pistons 417, 427 to stroke a first time. After the first stroke, the first reaming tool 412 remains in the inactive state while the second reaming tool 422 actuates into the active state. A second ball 415-2 may then be dropped down the drill string from the surface. The second ball 415-2 may cause the first and second cam-pistons 417, 427 to stroke a second time. After the second stroke, the first reaming tool 412 actuates into the active state, and the second reaming tool 422 actuates into the inactive state. A third ball 415-3 may then be dropped down the drill string from the surface. The third ball 415-3 may cause the first and second cam-pistons 417, 427 to stroke a third time. After the third stroke, the first reaming tool 412 remains in the active state, and the second reaming tool 422 actuates into the active state. A fourth ball 415-4 may then be dropped down the drill string from the surface. The fourth ball 415-4 may cause the first and second cam-pistons 417, 427 to stroke a fourth time. After the fourth stroke, the first and second reaming tools 412, 422 both actuate into the inactive state, thereby completing the cycle.

Thus, the indexing mechanisms 500, 600 allow the reaming tools 412, 422 to be selectively actuated based upon the number of balls 415 dropped into the tool 400. It may be appreciated that the indexing mechanisms 500, 600 are only exemplary, and other designs are also contemplated herein. It may also be appreciated that this concept may be applied to more than two drilling assemblies 410, 420 coupled to the tool 400. For example, this concept may be applied to a tool having 2, 3, 4, 5, 6, 7, 8, 9, 10, or more drilling assemblies coupled to the tool 400.

Figure 8:
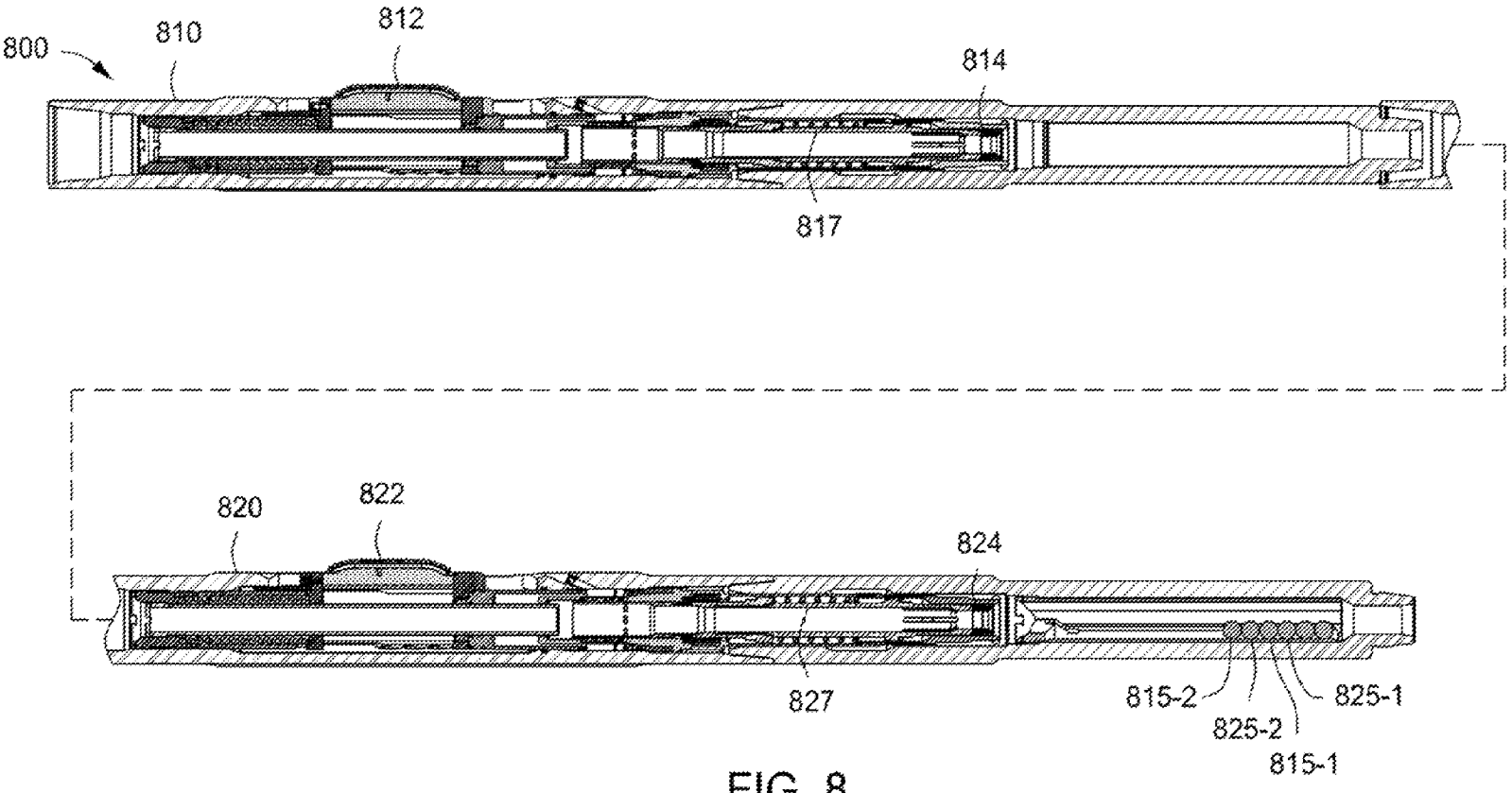
FIG. 8 depicts a cross-sectional view of another illustrative downhole tool including a plurality of drilling assemblies coupled thereto in tandem, according to one or more embodiments disclosed.

FIG. 8 depicts a cross-sectional view of another illustrative downhole tool 800 including a plurality of drilling assemblies 810, 820 coupled thereto in tandem, according to one or more embodiments. The drilling assemblies 810, 820 may be generally similar to the drilling assemblies 110, 120 depicted in FIG. 1, and like components will not be described again in detail. For example, the ball seat 814 may have a larger cross-sectional area e.g., diameter, than the ball seat 824. As such, a "small" ball 825 may pass through the first ball seat 814 without actuating the first reaming tool 812. The small ball 825 may, however, actuate the second reaming tool 822. A "large" ball 815 may actuate the first reaming tool 812 and subsequently actuate the second reaming tool 822. It may be appreciated that a greater pressure may be required to cause the large ball 815 to pass through the ball seat 824 than is required for the small ball 825.

Thus, in operation, both reaming tools 812, 822 may begin in the inactive state. A first, small ball 825-1 may be dropped down the drill string from the surface. The first ball 825-1 passes through the first reaming tool 812 and actuates the second reaming tool 822 into the active state. A second, large ball 815-1 may then be dropped down the drill string from the surface. The second ball 815-1 actuates the first reaming tool 812 into the active state and subsequently actuates the second reaming tool 822 into the inactive state. A third, small ball 825-2 may then be dropped down the drill string from the surface. The third ball 825-2 passes through the first reaming tool 812 and actuates the second reaming tool 822 into the active state. A fourth, large ball 815-2 may then be dropped down the drill string from the surface. The fourth ball 815-2 actuates the first and second reaming tools 812, 822 into the inactive state, thereby completing the cycle. It may be appreciated that this sequence is provided for illustrative purposes, and the large and small balls 815-1, 815-2, 825-1, 825-2 may be dropped in any number and any order to selectively actuate the reaming tools 812, 822.

Figure 9:
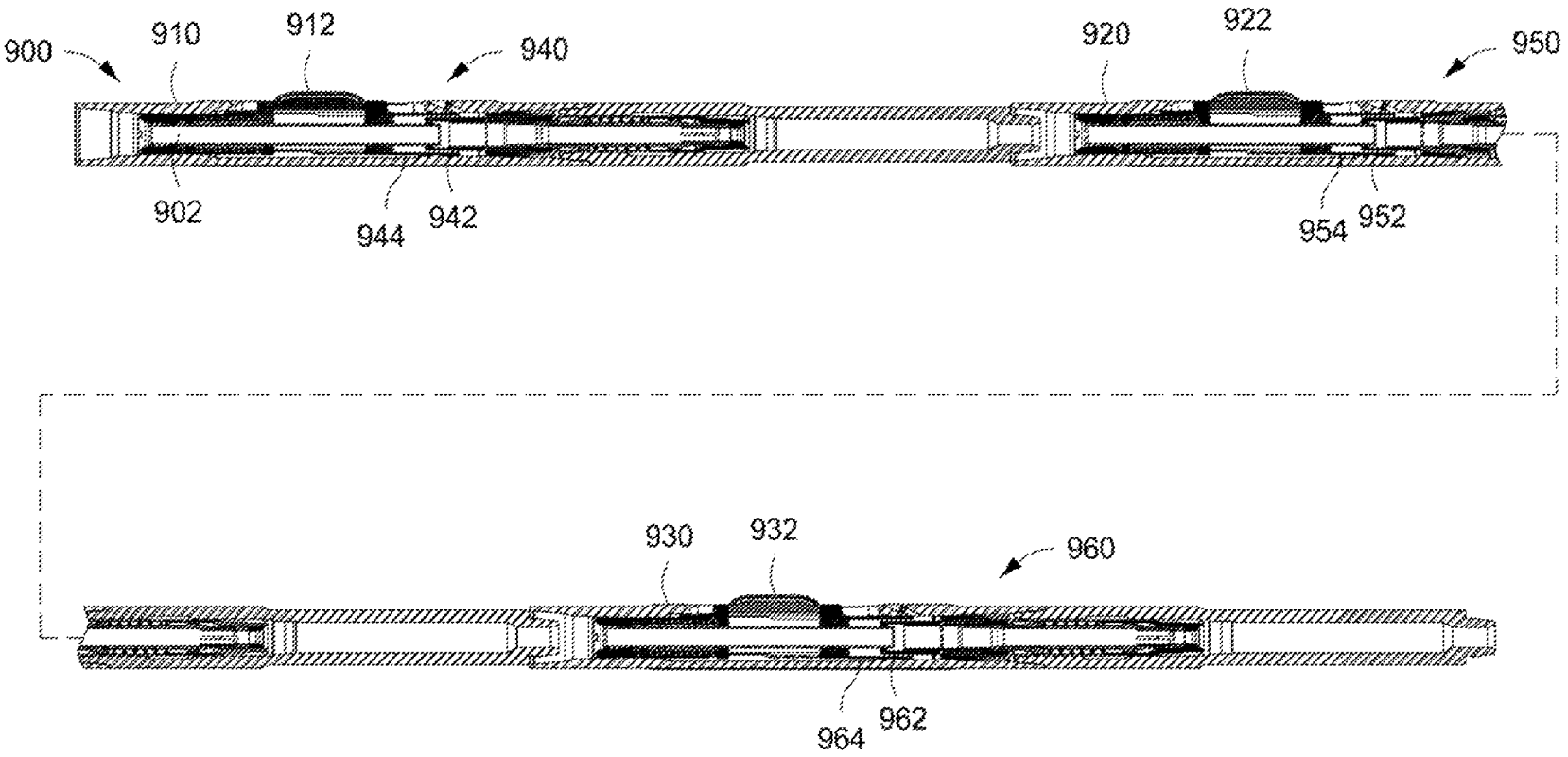
FIG. 9 depicts a cross-sectional view of yet another illustrative downhole tool including a plurality of drilling assemblies coupled thereto in tandem, according to one or more embodiments disclosed.

FIG. 9 depicts a cross-sectional view of yet another illustrative downhole tool 900 including a plurality of drilling assemblies 910, 920, 930 coupled thereto in tandem, according to one or more embodiments. Each drilling assembly 910, 920, 930 may include a flow control device 940, 950, 960. Illustrative flow control devices 940, 950, 960 are shown and described in U.S. Pat. No. 6,289,999.

The flow control devices 940, 950, 960 are adapted to selectively actuate a valve 942, 952, 962 disposed within the drilling assembly 910, 920, 930 between an open position and a closed position. When in the open position, fluid may flow through a central flow passage 902 that extends through the tool 900 and each of the drilling assemblies 910, 920, 930. When in the closed position, the valve 942, 952, 962 blocks flow through the central flow passage 902, and the fluid may be directed through a bypass passage 944, 954, 964. The reaming tools 912, 922, 932 are adapted to actuate into the active state when fluid flows therethrough via the central flow passage 902, and into the inactive state when the fluid flows through the bypass passages 944, 954, 964, or vice versa.

In operation, the first reaming tool 912 may be actuated into the active state by opening the first valve 942 with the first flow control device 940 so that fluid may flow through the first reaming tool 912 via the central flow passage 902. The first reaming tool 912 is then actuated into the inactive state by closing the first valve 942 with the first flow control device 940 so that the fluid instead flows through the first bypass passage 944. Similarly, the second reaming tool 922 may be actuated into the active state by opening the second valve 952 with the second flow control device 950 so that fluid may flow through the second reaming tool 922 via the central flow passage 902. The second reaming tool 922 is then actuated into the inactive state by closing the second valve 952 with the second flow control device 950 so that the fluid instead flows through the second bypass passage 954. The third reaming tool 932 may be actuated into the active state by opening the third valve 962 with the third flow control device 960 so that fluid may flow through the third reaming tool 932 via the central flow passage 902. The third reaming tool 932 is then actuated into the inactive state by closing the third valve 962 with the third flow control device 960 so that the fluid instead flows through the third bypass passage 964.

In at least one embodiment, each drilling assembly 910, 920, 930 may include a control unit (not shown) and a valve 942, 952, 962. The control units and/or the valves 942, 952, 962 are adapted to receive signals from the surface. The signals may include an RPM sequence, a flow and/or pressure pulse, a radio signal, communication from a bottom hole assembly (BHA) component, and the like. In at least one embodiment, the signals may be transmitted via wired pipe. Upon receiving the signals, the control units may be adapted to alter the position of the valves 942, 952, 962, and the valves 942, 952, 962 may actuate the reaming tools 912, 922, 932. Thus, the signals may selectively actuate the reaming tools 912, 922, 932 independent of one another.

In another embodiment, the first reaming tool 912 may be actuated by one or more balls (not shown), as described with reference to FIG. 1 above. Thus, a ball may become lodged in the ball seat. Pressure may then be applied to the drill string from the surface via pump drilling fluid. As the pressure builds, the ball seat and the piston may move or stroke in the first axial direction until the pressure reaches a predetermined amount where the ball seat deforms and allows the ball to pass therethrough and become retained within the ball catcher. The ball seat and the piston may then move or stroke in the second axial direction via spring action, thereby actuating the reaming tool 912 between the inactive state and the active state.

The second reaming tool 922 may be actuated by one or more signals as described above. For example, the second reaming tool 922 may be actuated with a flow and/or pressure pulse signal. The third reaming tool 932 may be electromechanically actuated with a control unit. Thus, the reaming tools 912, 922, 932 may each be selectively actuated by different mechanisms.

As used herein, the terms "inner" and "outer," "up" and "dowry," "upper" and "lower;" "upward" and "downward;" "above" and "below," "inward" and "outward;" and other like terms as used herein refer to relative positions to one another and are not intended to denote a particular direction or spatial orientation. The terms "large," "medium," "small," "long," "short," and the like are used herein to refer to relative sizes to one another. The terms "couple," "coupled," "connect," "connection," "connected," "in connection with," and "connecting" refer to "in direct connection with" or "in connection with via another element or member."

Although only a few example embodiments have been described in detail above, those skilled in the art will readily appreciate that many modifications are possible in the example embodiments without materially departing from "Selective Deployment of Underreamers and Stabilizers," Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A downhole tool for increasing a cross-sectional area of a wellbore, comprising:

a first drilling assembly including:

a first reaming tool adapted to selectively increase the cross-sectional area of the wellbore;

a first ball seat adapted to receive a first ball, wherein at least one of the first ball seat or the first ball is adapted to deform to allow the first ball to pass through the first ball seat when a predetermined pressure is applied thereto;

a first piston coupled to the first ball seat, wherein the first ball seat and the first piston are adapted to stroke when the first ball is received within the first ball seat, thereby actuating the first reaming tool between an active state and an inactive state, wherein two strokes of the first piston are required to actuate the first reaming tool between the active and inactive states; and a first indexing mechanism coupled to the first piston, wherein the first indexing mechanism rotates in response to strokes of the first piston and the first ball seat; and a second drilling assembly axially offset from the first drilling assembly along the downhole tool, the second drilling assembly including:

a second reaming tool adapted to selectively increase the cross-sectional area of the wellbore;

a second ball seat adapted to receive a second ball, wherein at least one of the second ball seat or the second ball is adapted to deform to allow the second ball to pass through the second ball seat when a predetermined pressure is applied thereto;

a second piston coupled to the second ball seat, wherein the second ball seat and the second piston are adapted to stroke when the second ball is received within the second ball seat, thereby actuating the second reaming tool between an active state and an inactive state, wherein one stroke of the second piston is required to actuate the second reaming tool between the active and inactive states; and a second indexing mechanism coupled to the second piston, wherein the second indexing mechanism rotates in response to strokes of the second piston and the second ball seat.

2. The downhole tool of claim 1, wherein a cross-sectional area of an aperture through the first ball seat is greater than a cross-sectional area of an aperture through the second ball seat, and wherein a cross-sectional area of the first ball is greater than a cross-sectional area of the second ball.

3. The downhole tool of claim 2, wherein the second ball is adapted to flow through the first ball seat before being received within the second ball seat such that the second ball does not actuate the first reaming tool.

4. The downhole tool of claim 3, wherein the first drilling assembly further comprises a first ball catcher adapted to retain the first ball after the first ball passes through the first ball seat.

5. The downhole tool of claim 3, wherein the first ball is adapted to actuate the first and second reaming tools, and wherein the second ball is adapted to actuate the second reaming tool.

6. The downhole tool of claim 1, wherein a cross-sectional area of the first ball seat is the same as a cross-sectional area of the second ball seat, and wherein the first ball is adapted to actuate the first and second reaming tools sequentially.

7. A downhole tool for increasing a cross-sectional area of a wellbore, comprising:

a first drilling assembly including:

a first reaming tool adapted to selectively increase the cross-sectional area of the wellbore;

a first ball seat adapted to receive a ball, wherein at least one of the first ball seat or the ball is adapted to deform to allow the ball to pass through the first ball seat when a predetermined pressure is applied thereto;

a first piston coupled to the first ball seat, wherein the first ball seat and the first piston are adapted to stroke when the ball is received within the first ball seat; and a first indexing mechanism coupled to the first piston, wherein the first indexing mechanism actuates the first reaming tool between an active state and an inactive state after each stroke of the first piston;

a second drilling assembly axially offset from the first drilling assembly along the downhole tool, the second drilling assembly including:

a second reaming tool adapted to selectively increase the cross-sectional area of the wellbore;

a second ball seat adapted to receive the ball, wherein at least one of the second ball seat or the ball is adapted to deform to allow the ball to pass through the second ball seat when a predetermined pressure is applied thereto;

a second piston coupled to the second ball seat, wherein the second ball seat and the second piston are adapted to stroke when the ball is received within the second ball seat; and a second indexing mechanism coupled to the second piston, wherein the second indexing mechanism actuates the second reaming tool between an active state and an inactive state after two strokes of the second piston.

8. The downhole tool of claim 7, further comprising a cartridge positioned radially outward from the first indexing mechanism, wherein the cartridge is adapted to rotate at least partially around a longitudinal axis therethrough during each stroke of the first piston.

9. The downhole tool of claim 8, wherein the cartridge rotates in response to the movement of the first indexing mechanism.

10. The downhole tool of claim 7, further comprising a spring coupled to the first piston, wherein the spring is adapted to contract when the ball is received in the first ball seat and to expand when the ball passes through the first ball seat.

11. The downhole tool of claim 7, further comprising a first mandrel, wherein the first piston is disposed within the first mandrel.

12. The downhole tool of claim 11, wherein one or more first radial ports are formed through the first mandrel, and one or more second radial ports are formed through the first piston, and wherein the first reaming tool is in the active state when the one or more first radial ports are aligned with the one or more second radial ports.

13. A method for increasing a cross-sectional area of a wellbore, comprising:

running a downhole tool into the wellbore, wherein the downhole tool includes first and second drilling assemblies coupled thereto and axially offset from one another;

receiving a first ball within a first ball seat of the first drilling assembly, wherein at least one of the first ball seat or the first ball is adapted to deform when a predetermined pressure is reached to allow the first ball to pass through the first ball seat;

moving the first ball seat and a first piston coupled thereto in response to the first ball being received in the first ball seat, thereby actuating a first reaming tool of the first drilling assembly between an active state and an inactive state, wherein the first reaming tool increases a cross-sectional area of the wellbore in the active state, and wherein the first piston is coupled to a first indexing mechanism adapted to repeatedly actuate the first reaming tool between active and inactive states in response to movement of the first ball seat and the first piston, the first indexing mechanism actuating the first reaming tool by using two strokes of the first piston;

receiving a second ball within a second ball seat of the second drilling assembly, wherein at least one of the second ball seat or the second ball is adapted to deform when the predetermined pressure is reached to allow the second ball to pass through the second ball seat; and moving the second ball seat and a second piston coupled thereto in response to the second ball being received in the second ball seat, thereby actuating a second reaming tool of the second drilling assembly between the active state and the inactive state, wherein the second reaming tool increases the cross-sectional area of the wellbore in the active state, and wherein the second piston is coupled to a second indexing mechanism adapted to repeatedly actuate the second reaming tool between active and inactive states in response to movement of the second ball seat and the second piston, the second indexing mechanism actuating the second reaming tool by using one stroke of the second piston.

14. The method of claim 13, wherein a cross-sectional area of the first ball seat is greater than a cross-sectional area of the second ball seat, and wherein a cross-sectional area of the first ball is greater than a cross-sectional area of the second ball.

15. The method of claim 14, further comprising flowing the second ball through the first ball seat before the second ball is received in the second ball seat such that the second ball does not actuate the first reaming tool.

16. The method of claim 15, further comprising retaining the first ball within a first ball catcher after the first ball passes through the first ball seat.

17. The method of claim 15, further comprising:

actuating the first and second reaming tools with the first ball; and actuating the second reaming tool with the second ball.

18. The method of claim 13, further comprising actuating the first and second reaming tools sequentially with the first ball, wherein a cross-sectional area of the first and second ball seats is the same.

19. The method of claim 13, the first and second balls being different sizes, the method further comprising using a third ball to stroke the first piston and the second piston to deactivate the first and second drilling assemblies.

20. The method of claim 13, further comprising retaining the first and second balls within a ball catcher positioned downhole of both the first and second drilling assemblies.

* * * * *